US011573029B2

(12) United States Patent
Nanjappa et al.

(10) Patent No.: US 11,573,029 B2
(45) Date of Patent: Feb. 7, 2023

(54) COLLAPSIBLE VENT HOOD FOR HVAC UNIT

(71) Applicant: Johnson Controls Technology Company, Auburn Hills, MI (US)

(72) Inventors: Vinay Nanjappa, Bangalore (IN); Nitin C. Dabade, Sangli (IN); Prashanti S. Dhawan, Pune (IN); Vishal S. Jagtap, Thane (IN); Anil V. Bhosale, Varunji (IN); Marcel P. Ferrere, Dalmatia, PA (US); Curtis W. Caskey, Dallastown, PA (US); Rajiv K. Karkhanis, York, PA (US); Chandra S. Yelamanchili, York, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 633 days.

(21) Appl. No.: 16/037,804

(22) Filed: Jul. 17, 2018

(65) Prior Publication Data

US 2019/0383514 A1 Dec. 19, 2019

Related U.S. Application Data

(60) Provisional application No. 62/686,521, filed on Jun. 18, 2018.

(51) Int. Cl.

| | |
|---|---|
| ***F24F 13/08*** | (2006.01) |
| ***F24F 13/20*** | (2006.01) |
| ***F24F 1/56*** | (2011.01) |
| *F24F 13/14* | (2006.01) |

(52) U.S. Cl.

CPC ..... *F24F 13/084* (2013.01); *F24F 1/56* (2013.01); *F24F 13/085* (2013.01); *F24F 13/20* (2013.01); *F24F 13/1486* (2013.01); *F24F 2221/52* (2013.01)

(58) Field of Classification Search

CPC ..... F24F 13/084; F24F 1/56; F24F 13/085; F24F 13/20; F24F 13/1486; F24F 2221/52

USPC ..... 454/367

See application file for complete search history.

(56) References Cited

U.S. PATENT DOCUMENTS

| | | | | | |
|---|---|---|---|---|---|
| 1,022,870 | A * | 4/1912 | Power | E06B 7/26 | 454/218 |
| 1,332,493 | A * | 3/1920 | Graf | E06B 7/10 | 454/211 |
| 2,557,676 | A * | 6/1951 | Miller | E04F 10/10 | 160/129 |
| 2,920,464 | A * | 1/1960 | Trask | F24F 1/56 | 62/428 |

(Continued)

*Primary Examiner* — Avinash A Savani
*Assistant Examiner* — Dana K Tighe
(74) *Attorney, Agent, or Firm* — Fletcher Yoder, P.C.

(57) ABSTRACT

Embodiments of the present disclosure are directed to collapsible hood for a heating and cooling system that includes a plurality of panels configured to couple to a housing of the heating and cooling system, wherein the plurality of panels is configured to be translated between a collapsed position and an open position, wherein the plurality of panels is substantially flush against the housing in the collapsed position to configure the heating and cooling system for transportation, and wherein the plurality of panels are configured to extend from the housing to protect openings in an air intake of the housing and to allow passage of air through the air intake in the open position.

21 Claims, 17 Drawing Sheets

(56) References Cited

U.S. PATENT DOCUMENTS

| | | | | |
|---|---|---|---|---|
| 2,925,769 | A * | 2/1960 | Kubatzky | E06B 7/06 454/225 |
| 5,769,709 | A | 6/1998 | Kim | |
| 5,887,317 | A * | 3/1999 | Baker | E05D 11/1007 16/329 |
| 6,595,017 | B1 | 7/2003 | Teahan | |
| 7,000,411 | B2 | 2/2006 | Kim et al. | |
| 7,032,402 | B2 | 4/2006 | Braswell | |
| 7,174,740 | B2 | 2/2007 | Cha et al. | |
| 7,836,653 | B1 | 11/2010 | Herrington | |
| 9,435,561 | B2 | 9/2016 | Bowen | |
| 9,845,969 | B2 | 12/2017 | Ali | |
| 2005/0170772 | A1 | 8/2005 | De Domenico | |
| 2008/0009235 | A1 | 1/2008 | Klepfer et al. | |
| 2008/0178624 | A1 | 7/2008 | Zedney | |
| 2012/0214401 | A1 | 8/2012 | Ye | |
| 2013/0005238 | A1 | 1/2013 | Brandt | |
| 2013/0072103 | A1 | 3/2013 | Hopkins et al. | |
| 2013/0130611 | A1 | 5/2013 | Dinicolas | |
| 2014/0117681 | A1* | 5/2014 | Jenkins | E05C 19/184 292/256.71 |
| 2016/0356508 | A1 | 12/2016 | Nguyen | |
| 2017/0089628 | A1 | 3/2017 | Jang et al. | |

* cited by examiner

COLLAPSIBLE VENT HOOD FOR HVAC UNIT

CROSS REFERENCE TO RELATED APPLICATIONS

This application claims priority from and the benefit of U.S. Provisional Application Ser. No. 62/686,521, entitled "COLLAPSIBLE VENT HOOD FOR HVAC UNIT," filed Jun. 18, 2018, which is hereby incorporated by reference in its entirety for all purposes.

BACKGROUND

The present disclosure relates generally to environmental control systems, and more particularly, to a collapsible vent hood for a heating, ventilation, and air conditioning (HVAC) unit.

Environmental control systems are utilized in residential, commercial, and industrial environments to control environmental properties, such as temperature and humidity, for occupants of the respective environments. The environmental control system may control the environmental properties through control of an airflow delivered to the environment. In some cases, heating, ventilation, and air conditioning (HVAC) systems include a hood that is configured to block water and other contaminants from gaining entry into an air intake of a unit. For instance, an outdoor unit of an HVAC system may draw air into the unit, which ultimately passes over coils of a heat exchanger to exchange thermal energy with a working fluid flowing through the coils of the heat exchanger. Existing hoods are generally shipped separately from a housing of the unit, which increases transportation costs. In some cases, transporting an existing unit involves removal of the hood, which is time-consuming and expensive.

DRAWINGS

SUMMARY

Figure 1:
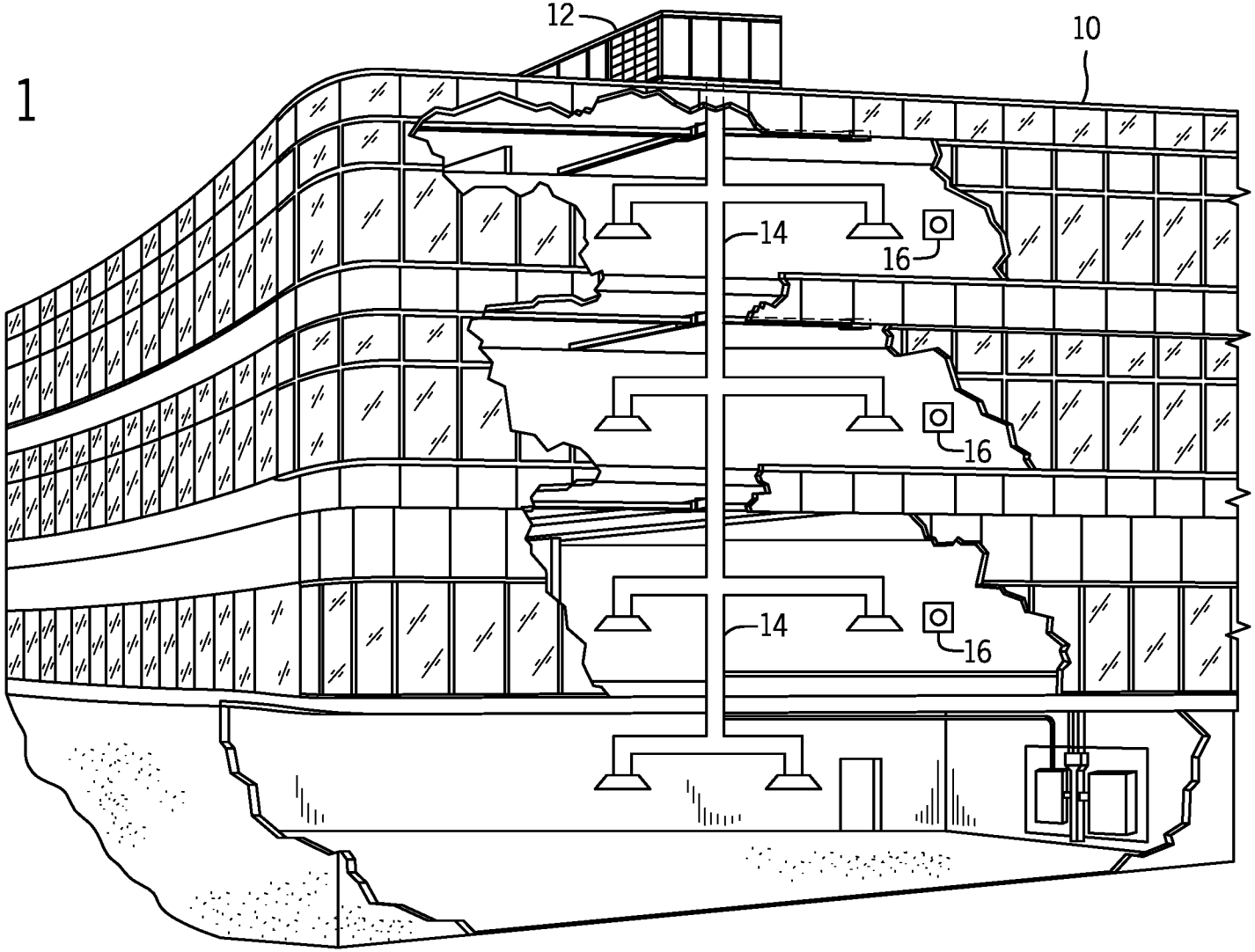
FIG. 1 is a schematic of an environmental control for building environmental management that may employ an HVAC unit, in accordance with an aspect of the present disclosure.

In one embodiment of the present disclosure, a collapsible hood for a heating and cooling system includes a plurality of panels configured to couple to a housing of the heating and cooling system, where the plurality of panels is configured to be translated between a collapsed position and an open position, where the plurality of panels is substantially flush against the housing in the collapsed position to configure the heating and cooling system for transportation, and where the plurality of panels are configured to extend from the housing to protect openings in an air intake of the housing and to allow passage of air through the air intake in the open position.

In another embodiment of the present disclosure, a heating and cooling system includes a housing configured to intake an airflow to be conditioned with a heat exchanger of the heating and cooling system and a collapsible hood assembly coupled to the housing, where the collapsible hood assembly includes a plurality of panels configured to restrict contaminants from entering an opening of the housing that receives the air flow in an operating position, and where the plurality of panels is configured to be substantially flush against a side of the housing in a collapsed position, such that the heating and cooling system is configured to be transported in the collapsed position.

In a further embodiment of the present disclosure, a collapsible hood assembly includes a plurality of side panels configured to couple to a side of a housing of a heating, ventilation, and air conditioning (HVAC) unit in an operating position and a plurality of primary panels configured to couple to the side of the housing and to the plurality of side panels in the operating position, where the plurality of side panels and the plurality of primary panels cooperatively form a plurality of protected air intake passages of the housing of the HVAC unit in the operating position, where the plurality of side panels and the plurality of primary panels are configured to be adjusted from the operating position to a collapsed position, and where the plurality of side panels and the plurality of primary panels are substantially flush against the side of the housing in the collapsed position, such that the HVAC unit is configured to be transported in the collapsed position.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to an improved hood assembly configured to be disposed over an air intake of a heating, ventilation, and air conditioning (HVAC) unit. As discussed above, existing hoods may be removed and/or otherwise not assembled to an HVAC unit when the HVAC unit is to be transported from one location to another. As such, the HVAC unit and the hood are shipped to a new location separately from one another, which may increase transportation costs. Additionally, the hood is assembled, or otherwise reattached, to the HVAC unit when the separate components reach the final destination, which may be time-consuming and costly.

Accordingly, embodiments of the present disclosure are directed to a collapsible hood assembly that is configured to transition between an operating position and a collapsed position, or folded position. When the hood is in the operating position, the hood blocks water or other contaminants, such as dirt or particulates present in an environment surrounding the HVAC unit, from entering into the air intake of the HVAC unit, while enabling air to flow from the environment surrounding the HVAC unit into the HVAC unit. When the hood is in the collapsed position, a plurality of panels, such as a plurality of louvered panels, of the hood assembly is generally flush with a side of the HVAC unit. Accordingly, the hood may be transported with the HVAC unit without substantially increasing a size of the HVAC unit and without incurring additional costs for shipping the hood assembly separate from the HVAC unit. In some embodiments, a collapsible hood of the collapsible hood assembly includes a pair of side panels and a primary panel. The pair of side panels may be removed from the primary panel and subsequently attached to the primary panel in a collapsed configuration. In other embodiments, the pair of side panels may fold via a hinged connection to the HVAC unit, thereby enabling the pair of side panels to lay flat against a side or surface of the HVAC unit. In still further embodiments, the pair of side panels may be removed and slidably inserted into grooves of a bracket assembly having a filter, such that the side panels are positioned adjacent to the filter in the collapsed position. In any case, the collapsible hood assembly may be secured to the HVAC unit during transportation and may transition from the collapsed or folded position to the operating position upon reaching the final destination of the HVAC unit. As such, assembly and transportation costs of the hood assembly may be reduced.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
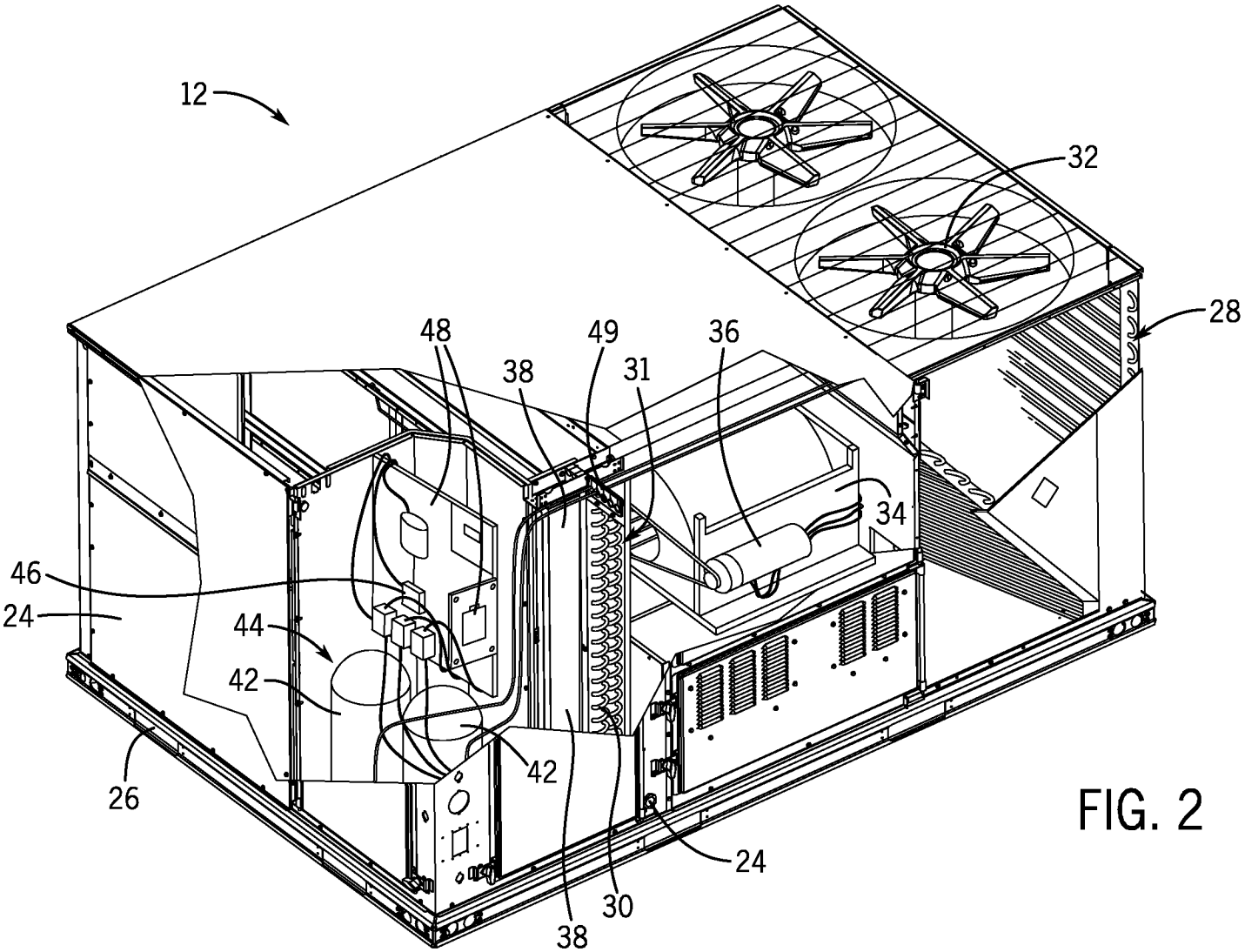
FIG. 2 is a perspective view of an embodiment of an HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
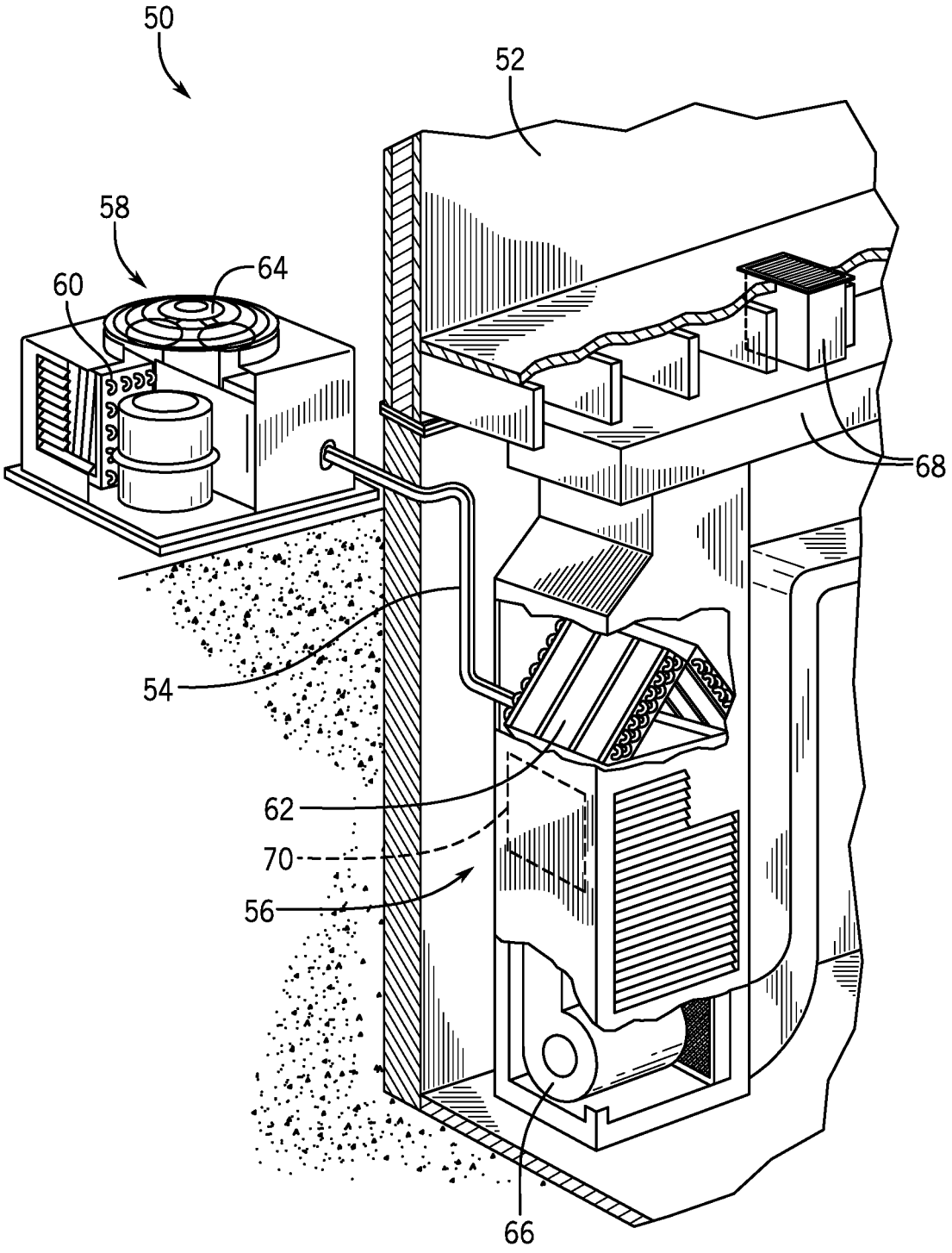
FIG. 3 is a schematic of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
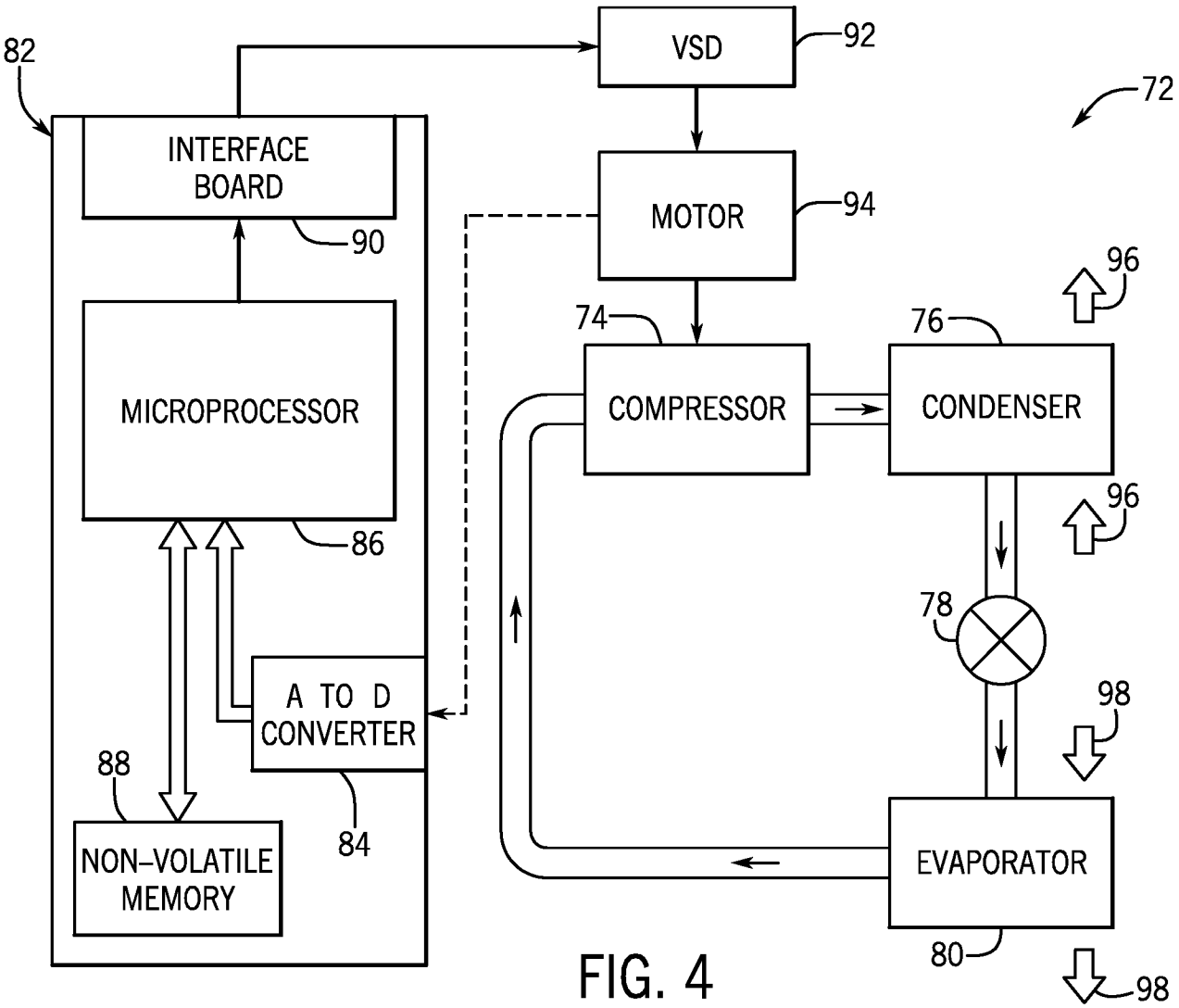
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a collapsible hood assembly that is configured to couple to an HVAC unit and transition from an operating position to a collapsed position, and vice versa. The collapsible hood assembly is configured to be assembled to the HVAC unit 12 and/or the outdoor HVAC unit 58, which are generally referred to as an HVAC unit. Additionally, the collapsible hood assembly may transition from the operating position to the collapsed position when transportation of the HVAC unit is desired. Therefore, the collapsible hood assembly may remain coupled to the HVAC unit during transportation, thereby reducing or eliminating separate shipping costs for both the collapsible hood assembly and the HVAC unit. Additionally, adjusting the collapsible hood between the collapsed position and the operating position may be less time-consuming when compared to a complete installation of the entire hood assembly. As such, an assembly time of the HVAC unit may also be also reduced.

Figure 5:
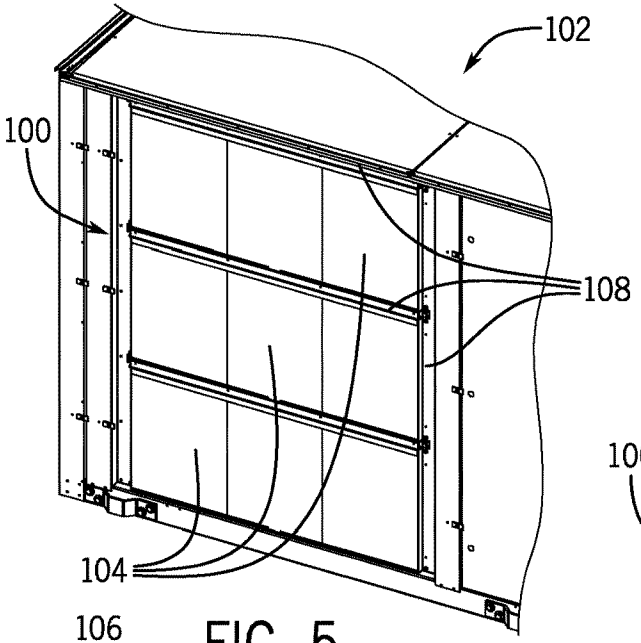
FIG. 5 is a perspective view of an embodiment of an air intake of an HVAC unit that may be utilized in any of the systems of FIGS. 1-3, in accordance with an aspect of the present disclosure.

As discussed above, the collapsible hood may be positioned over a side 100, such as a lateral side or surface, of an HVAC unit 102. For example, FIG. 5 is a perspective view of an embodiment of the side 100 of the HVAC unit 102. As shown in the illustrated embodiment of FIG. 5, the side 100 of the HVAC unit 102 includes filters 104 configured to block particulates and/or contaminants from entering an interior of the HVAC unit 102 from an environment 106 surrounding the HVAC unit 102. As discussed in detail herein with reference to FIGS. 25-28, the filters 104 may be positioned within a bracket assembly 108 that is configured to be disposed in an opening of the HVAC unit 102. Accordingly, air may be drawn through the filters 104 and into the interior of the HVAC unit 102 via a fan or blower, such that air may pass over coils of a heat exchanger within the HVAC unit 102.

Figure 7:
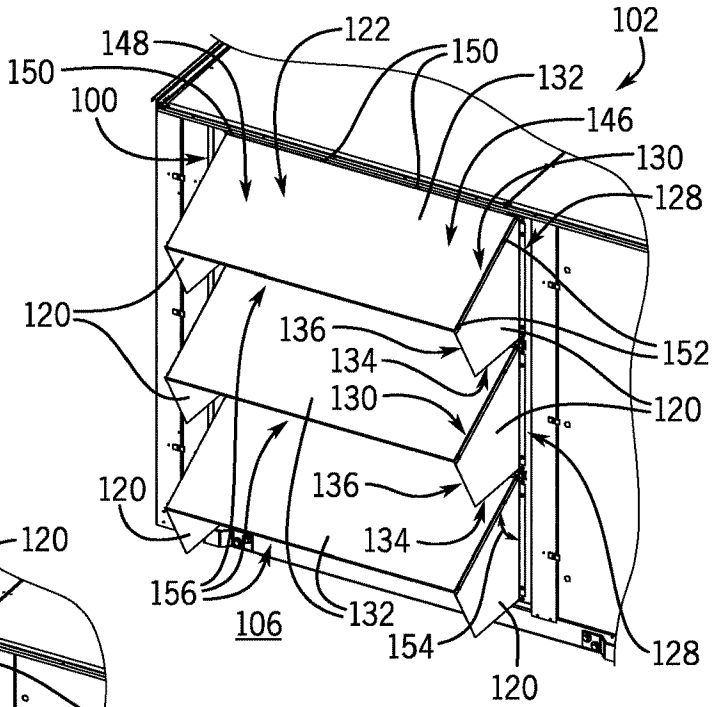
FIG. 7 is a perspective view of the side panels of the hood assembly and primary panels of the hood assembly in an operating position, in accordance with an aspect of the present disclosure.
Figure 6:
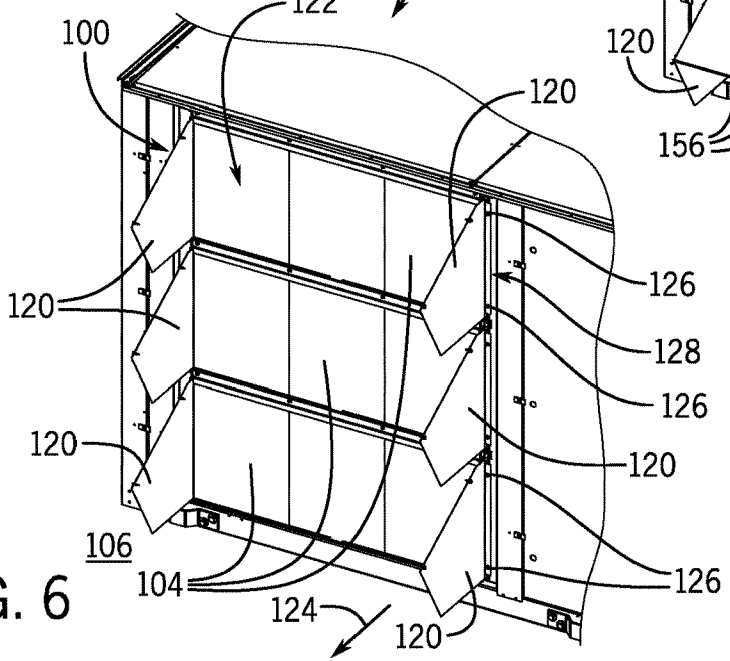
FIG. 6 is a perspective view of an embodiment of side panels of a hood assembly that is disposed over the air intake of FIG. 5, in accordance with an aspect of the present disclosure.

FIG. 6 is a perspective view of an embodiment of side panels 120 of a hood assembly 122 that is coupled to the side 100 of the HVAC unit 102. The hood assembly 122 is configured to block water and/or other contaminants from entering the interior of the HVAC unit 102 and/or otherwise through the filters 104. As shown in the illustrated embodiment of FIG. 6, the side panels 120 extend laterally outward from the side 100 of the HVAC unit 102 along an axis 124. The side panels 120 are secured to the side 100 of the HVAC unit 102 and/or the bracket assembly 108 via fasteners 126. In some embodiments, the side panels 120 may be quadrilaterals having a first edge 128 coupled to the side 100 of the HVAC unit 102 and/or the bracket assembly 108. Additionally, a second edge 130 of the side panels 120 may be configured to couple to a primary panel 132, as shown in FIG. 7. Further still, the side panels 120 may include a third edge 134, which is substantially crosswise, or perpendicular, to the first edge 128. The side panels 120 may also include a fourth edge 136 that extends between the second edge 130 and the third edge 134. While the side panels 120 are illustrated as being quadrilaterals, in other embodiments, the side panels 120 may include other suitable polygonal shapes, such as triangles, squares, rectangles, pentagons, or hexagons.

As shown in the illustrated embodiment of FIG. 7, the primary panels 132 are substantially rectangular and couple to the side 100 of the HVAC unit 102 as well as to the respective first sides 128 of a pair of the side panels 120. For example, a first side panel 120 is coupled to a first end 146 of the primary panel 132, and a second side panel 120 is coupled to a second end 148 of the primary panel 132. Additionally, the primary panels 132 are coupled to the side 100 of the HVAC unit 102 via fasteners 150 and to the first sides 128 of the pair of side panels 120 via fasteners 152. As such, movement of the hood assembly 122 is substantially blocked with respect to the HVAC unit 102, and the hood assembly 122 is secured to the HVAC unit 102. Additionally, when secured to the HVAC unit 102, the hood assembly 122 is configured to block water and/or other contaminants from reaching the interior of the HVAC unit 102. For example, the primary panels 132 are disposed at an angle 154 with respect to the first edge 128 of the side panels 120. As such, the primary panels 132 at least partially cover the filters 104 to block water and/or other contaminants from entering the HVAC unit 102. While the hood assembly 122 blocks water and/or contaminants from reaching the interior of the HVAC unit 102, air may still be directed into the HVAC unit 102 through gaps 156 between the primary panels 132 via a fan or blower of the HVAC unit 102. In other words, the side panels 120 and the primary panels form a plurality of protected openings 156 of an air intake for the HVAC unit 102.

Figure 8:
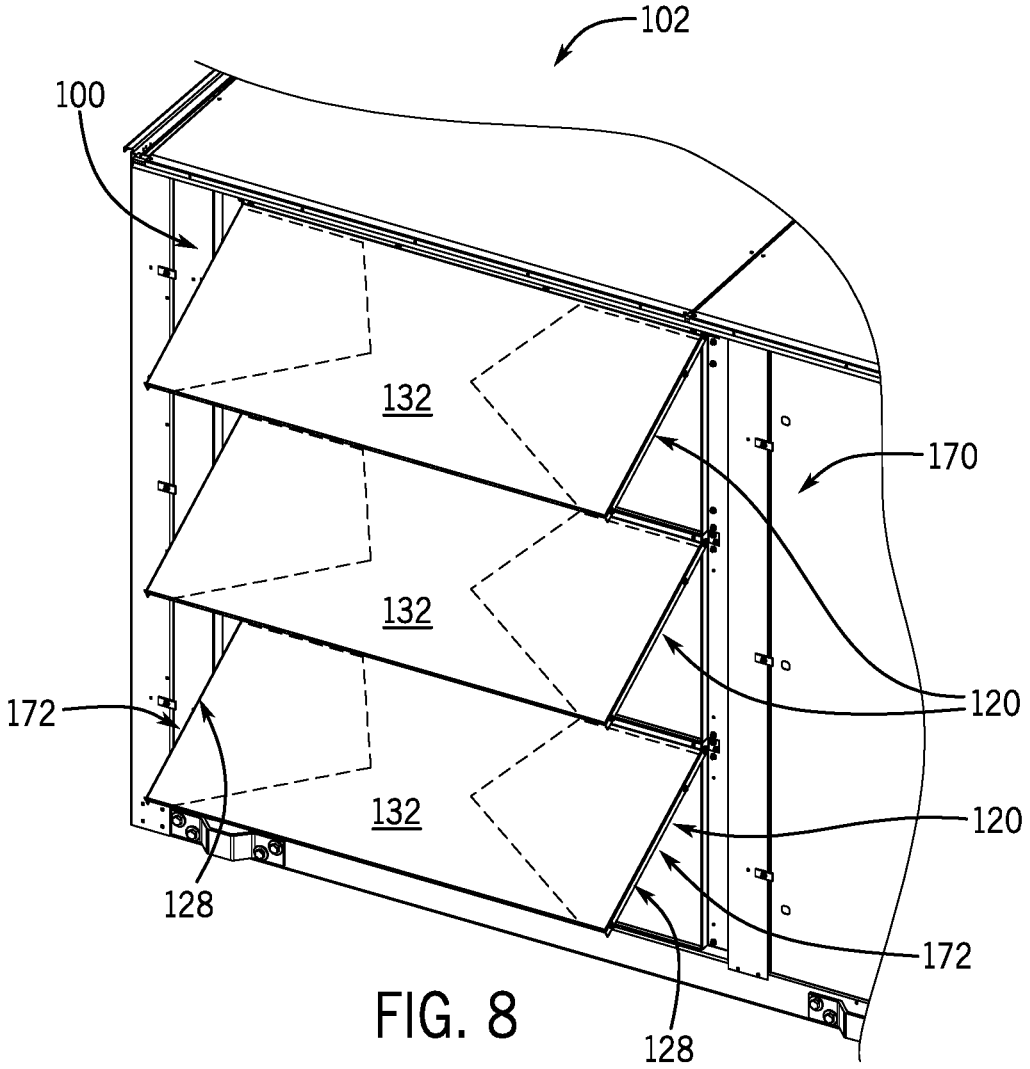
FIG. 8 is a perspective view of an embodiment of the side panels of the hood assembly in a collapsed position, in accordance with an aspect of the present disclosure.

As discussed above, embodiments of the present disclosure are directed to a collapsible hood assembly 122 that facilitates transportation of the HVAC unit 102 with the collapsible hood assembly 122 and reduces shipping costs and/or assembly costs of the collapsible hood assembly. For example, FIG. 8 is a perspective view of the hood assembly 122 in a partially collapsed position 170. As shown in the illustrated embodiment of FIG. 8, the side panels 120 are removed or detached from the side 100 of the HVAC unit 102, as well as from the primary panels 132. In some embodiments, fasteners 126 and fasteners 152 are removed, such that the side panels 120 are unattached from the hood assembly 122 and the HVAC unit 102. Accordingly, the side panels 120 may be adjusted and inserted into a pocket of the primary panels 132. For instance, the side panels 120 may be manipulated, such that the first edge 128 is positioned at an end 172 of the primary panel 132. The first edge 128 may include openings that are configured to align with corresponding openings disposed in the end 172 of the primary panel 132. As such, the side panels 120 may be secured to the primary panel 132, such as via fasteners, when the HVAC unit 102 is to be transported.

Figure 9:
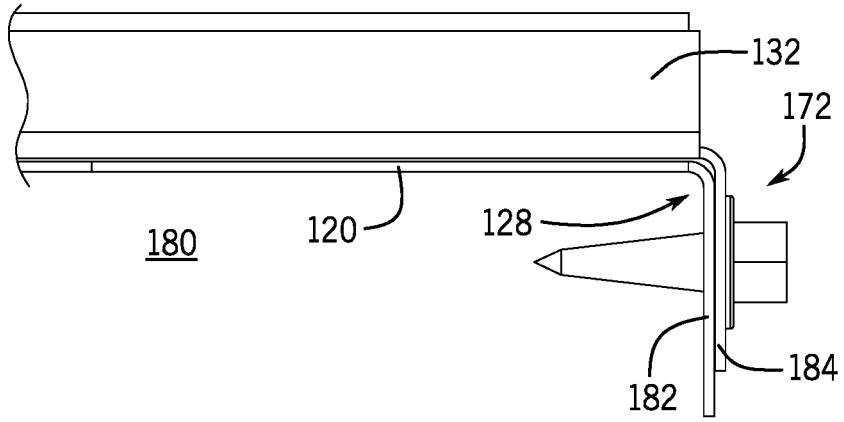
FIG. 9 is an expanded elevation view of a side panel of the hood assembly in the collapsed position, in accordance with an aspect of the present disclosure.

FIG. 9 is a partial elevation view illustrating a pocket 180 of the primary panel 132, as well as a side panel 120 disposed in the pocket 180. As shown in the illustrated embodiment of FIG. 9, a lip 182 extending from the first edge 128 of the side panel 120 is disposed adjacent to a corresponding lip 184 of the end 172 of the primary panel 132. When the lips 182 and 184 are positioned adjacent to one another, openings of the side panel 120 and the primary panel 132 may be aligned, such that fasteners may extend into the openings and secure the side panel 120 within the pocket 180 of the primary panel 132. As shown in the illustrated embodiment of FIG. 7, the lip 182 of the first edge 128 of the side panel 120 may also couple the side panel 120 to the side 100 of the HVAC unit 102 in the operating position via the fasteners 126.

Figure 10:
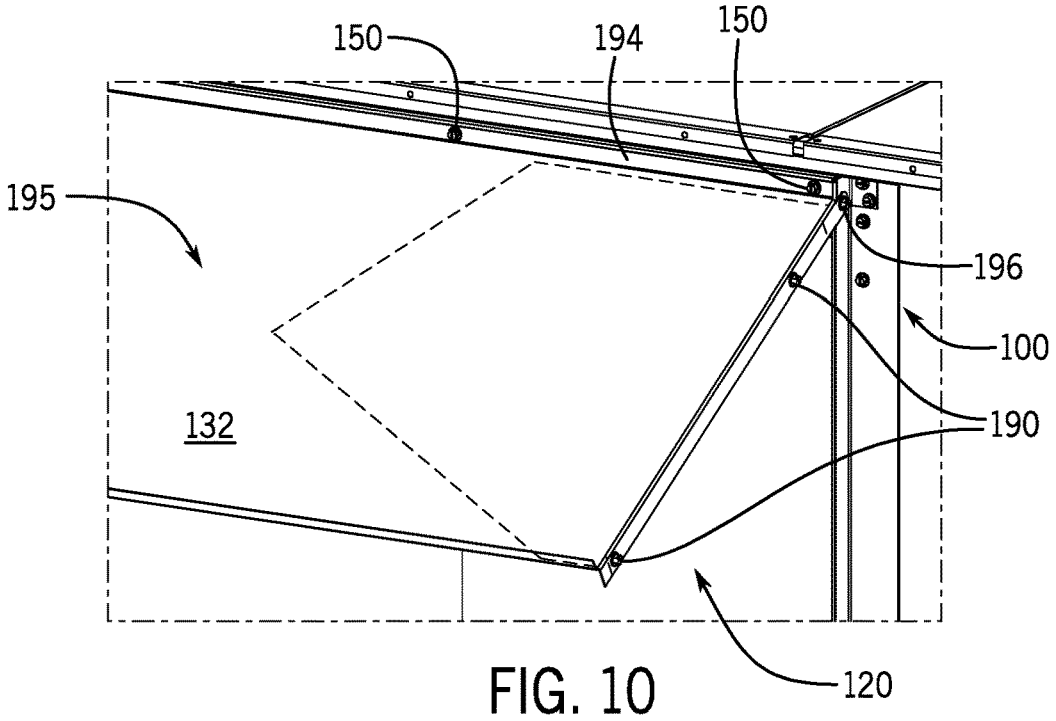
FIG. 10 is an expanded perspective view of a side panel of the hood assembly in the collapsed position, in accordance with an aspect of the present disclosure.
Figure 11:
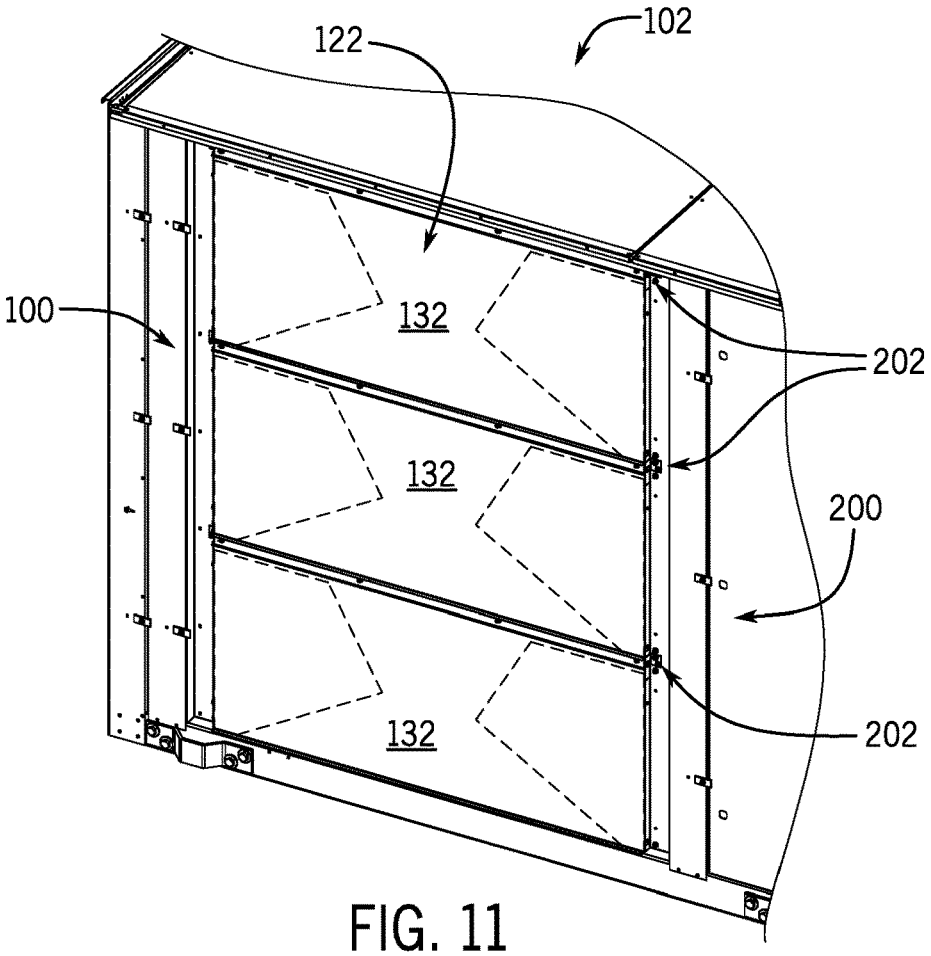
FIG. 11 is a perspective view of an embodiment of the side panels and the primary panels of the hood assembly in the collapsed position, in accordance with an aspect of the present disclosure.

FIG. 10 is an expanded perspective view of the side panel 120 disposed within the pocket 180 of the primary panel 132, including fasteners 190 extending through openings 192 of the primary panel 132 as well as openings of the side panel 120. As shown in the illustrated embodiment of FIG. 10, a portion 194 of the primary panel 132 is coupled to the side 100 of the HVAC unit 102 via the fasteners 150. As shown in the illustrated embodiment of FIG. 10, the portion 194 is positioned at an angle with respect to a surface 195 of the primary panel 132. Accordingly, the portion 194 is positioned substantially flush against the side 100 of the HVAC unit 102, while the surface 195 extends laterally outward from the side 100 of the HVAC unit 102 at the angle. The portion 194 and the surface 195 may be integrally formed or otherwise coupled to one another. Additionally, the primary panel 132 is hingedly coupled to the side 100 of the HVAC unit 102 via a fastener 196. In some embodiments, the fastener 196 may be tightened to block rotation of the primary panel 132 with respect to the side 100 of the HVAC unit 102 when the hood assembly 122 is in an operating position. The fastener 196 may also be loosened to enable rotation the primary panel 132 from the operating position to a collapsed position, as shown in FIG. 11. In other embodiments, the fastener 196 may include a bolt or cylindrical rod without threads that enables rotation of the primary panel 132 with respect to the side 100 of the HVAC unit 102 when the fasteners 150 are removed.

Further, FIG. 11 is a perspective view of the hood assembly 122 in a collapsed position 200. In some embodiments, the fasteners 150 are removed to partially uncouple the primary panels 132 from the side 100 of the HVAC unit 102. The primary panels 132 may be hingedly coupled to the side 100 of the HVAC unit 102 at joints 202, or at a position where the fastener 196 couples the primary panels 132 to the side 100 of the HVAC unit 102. Accordingly, the primary panels 132 may be folded toward the side 100 of the HVAC unit 102 and be positioned substantially flush against the side 100 of the HVAC unit 102. As used herein, substantially flush may refer to hood assembly 122, having the side panels 120 and the primary panels 132, being positioned flat against the side 100 of the HVAC unit 102. The hood assembly 122 thus remains coupled to the HVAC unit 102, but occupies a relatively small amount of additional space when compared to the HVAC unit 102 alone.

Figure 12:
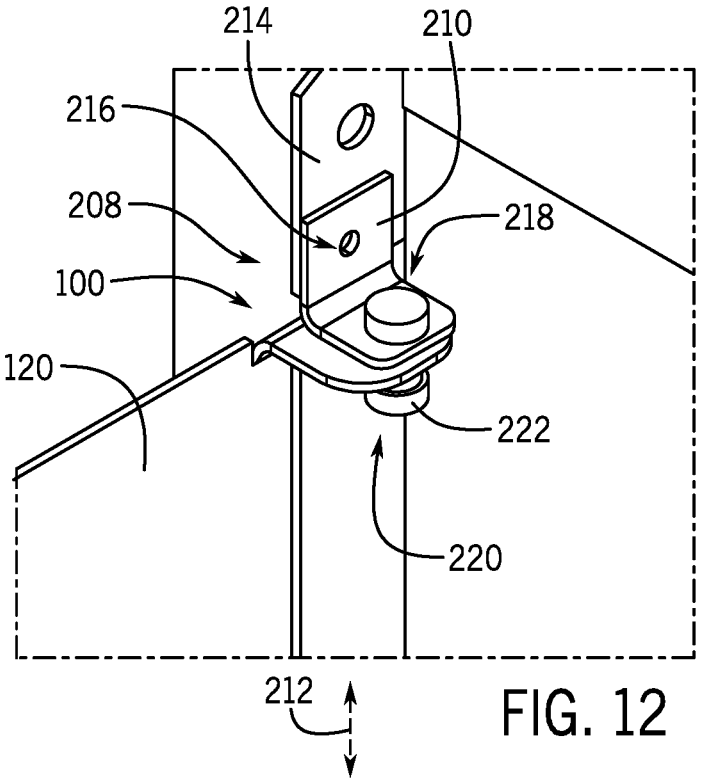
FIG. 12 is a perspective view of an embodiment of a bracket for foldable side panels, in accordance with an aspect of the present disclosure.
Figure 13:
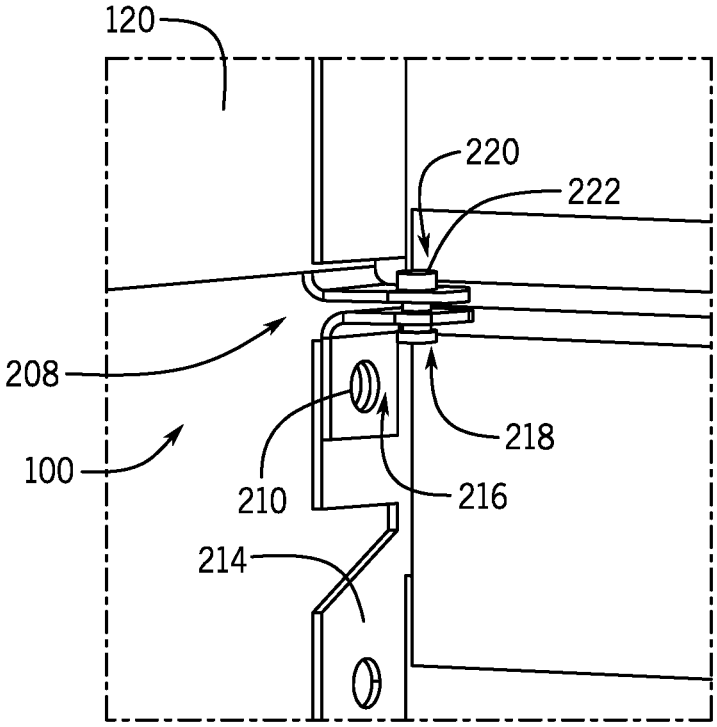
FIG. 13 is a perspective view of an embodiment of a bracket for the foldable side panels, in accordance with an aspect of the present disclosure.

In some embodiments, the side panels 120 are configured to fold toward the side 100 of the HVAC unit 102 via a hinged connection 208 to the side 100 of the HVAC unit 102 and/or the bracket assembly 108. For example, FIGS. 12 and 13 are perspective views of a bracket 210 configured to enable the side panels 120 to rotate about an axis 212 and fold inward toward the side 100 of the HVAC unit 102. As shown in the illustrated embodiments of FIGS. 12 and 13, the bracket 210 may be coupled to a frame portion 214 of the side 100 of the HVAC unit 102 and/or the bracket assembly 108. The bracket 210 may include an L-shape, such that a first arm 216 of the bracket 210 couples to the frame portion 214, and a second arm 218 of the bracket 210 couples to a hinge portion 220 extending from the side panel 120. The bracket 210 may be fixedly coupled to the frame portion 214, such that the brackets 210 are substantially stationary with respect to the frame portion 214. Further, a rod 222, or fastener, may couple the brackets 210 to the hinge portion 220 of the side panels 120. The hinge portions 220 may be configured to rotate about the axis 212 via the rod 222 and fold inward toward the side 100 of the HVAC unit 102.

Figure 14:
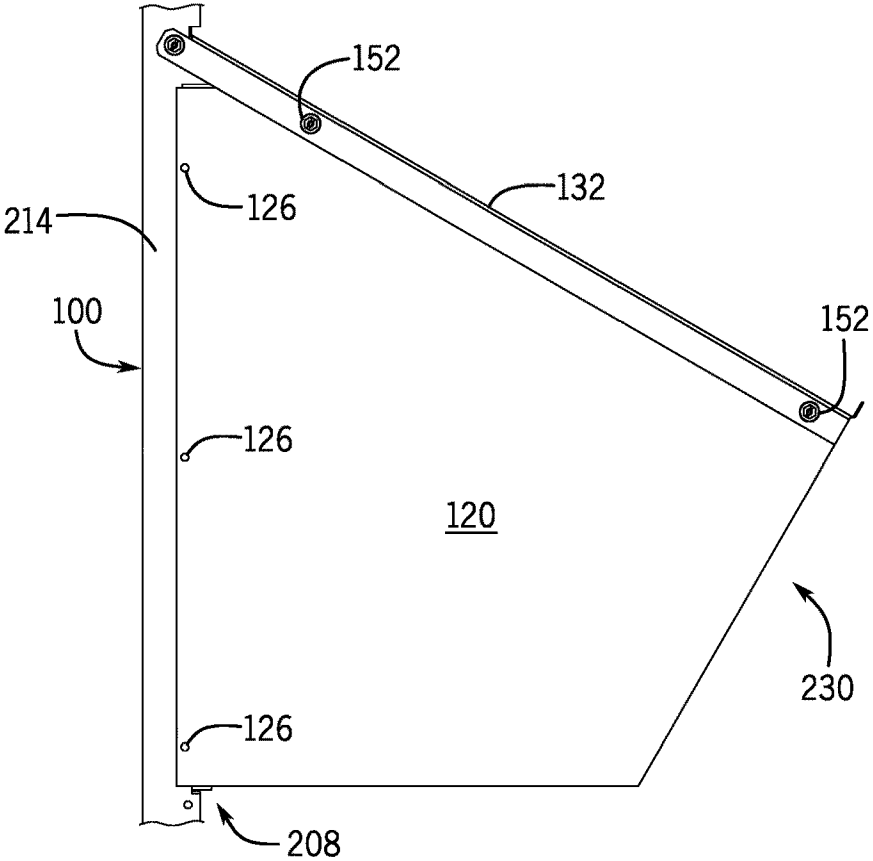
FIG. 14 is a side elevation view of an embodiment of a foldable primary panel, in accordance with an aspect of the present disclosure.

Similarly, the primary panels 132 may also be configured to fold toward the side 100 of the HVAC unit 102 when transitioning from an operating position 230 to the collapsed position 200. For example, FIG. 14 is a side elevation view of an embodiment of a hood of the hood assembly 122 in the operating position 230. As discussed above, when in the operating position 230, the side panel 120 is coupled to the side 100 of the HVAC unit 102 via the frame portion 214 and/or to the bracket assembly 108 via fasteners 126. Further, the side panel 120 is coupled to the primary panel 132 via the fasteners 152. To fold the side panels 120 toward the side 100 of the HVAC unit 102 using the hinged connection 208, the fasteners 126 and the fasteners 152 may be removed, such that the side panels 120 are coupled to the bracket 210 via the hinged connection 208, but not coupled to the primary panel 132 and/or directly coupled to the frame portion 214. As such, the side panels 120 may be rotated toward the side 100 of the HVAC unit 102 and into the collapsed configuration 200.

Figure 15:
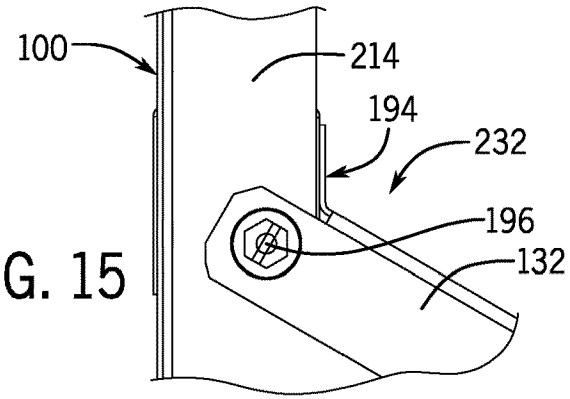
FIG. 15 is a side elevation view of an embodiment of the foldable primary panel for the hood assembly of FIGS. 7-14, in accordance with an aspect of the present disclosure.

FIG. 15 is an expanded side elevation view of an embodiment of a hinged connection 232 between the primary panel 132 and the side 100 of the HVAC unit 102 via the frame portion 214 and/or the bracket assembly 108. As shown in the illustrated embodiment of FIG. 15, the fastener 196 couples the primary panel 132 to the frame portion 214. As discussed above, the fastener 196 may be tightened when the hood assembly 122 is in the operating position 230, such that movement or rotational movement of the primary panel 132 is substantially blocked with respect to the side 100 of the HVAC unit 102 and/or the frame portion 214. In such embodiments, the fastener 196 is loosened to enable rotation of the primary panel 132 with respect to the frame portion 214 about the fastener 196. Additionally or alternatively, the fastener 196 may include an unthreaded bolt or rod, such that the fasteners 150 coupling the primary panel 132 to the side 100 of the HVAC unit 102 are removed to enable rotation of the primary panel 132 with respect to the side 100 of the HVAC unit 102 via the fastener 196.

Figure 16:
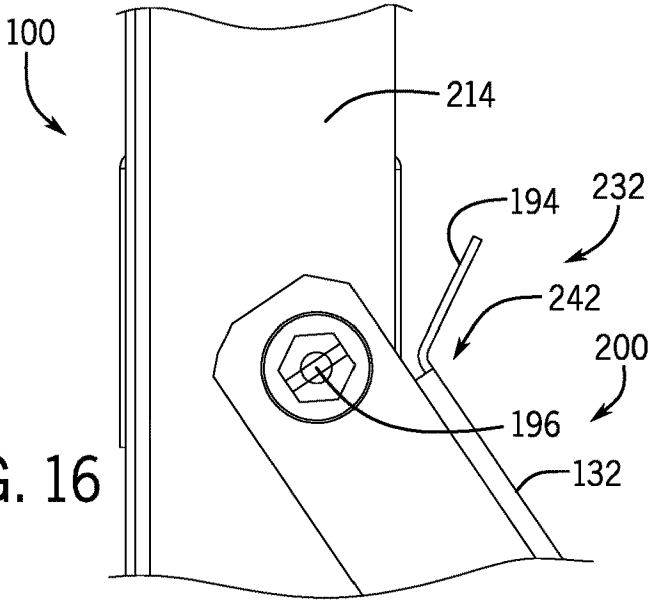
FIG. 16 is a side elevation view of an embodiment of the foldable primary panel for the hood assembly of FIGS. 7-14, in accordance with an aspect of the present disclosure.

FIG. 16 is an expanded side elevation view of the primary panel 132 in the collapsed position 200, or transitioning toward the collapsed position 200. In some embodiments, the primary panel 132 includes the portion 194 that receives the fasteners 150 and is disposed adjacent to a portion of the side 100 of the HVAC unit 12. As shown in the illustrated embodiment of FIG. 16, the portion 194 may extend from a surface 242 of the primary panel 132. As should be understood, the additional space occupied by the coupling portion 194 when in the collapsed position 200 is relatively small when compared to the primary panel 132 extending from the side 100 of the HVAC unit 102 in the operating position 230. As such, the hood assembly 122 may be adjusted to the collapsed position 200 during transportation, while enabling a size of the HVAC unit 102 to increase by a relatively negligible amount.

Figure 18:
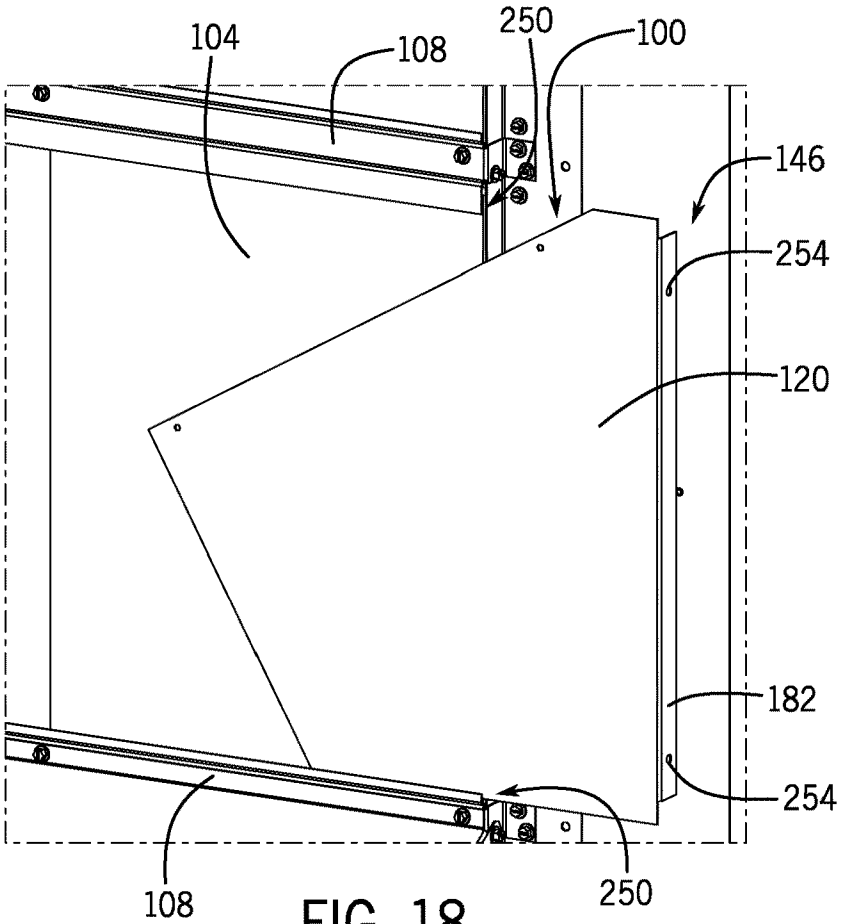
FIG. 18 is a perspective view of an embodiment of the slidable side panels of the hood assembly, in accordance with an aspect of the present disclosure.
Figure 17:
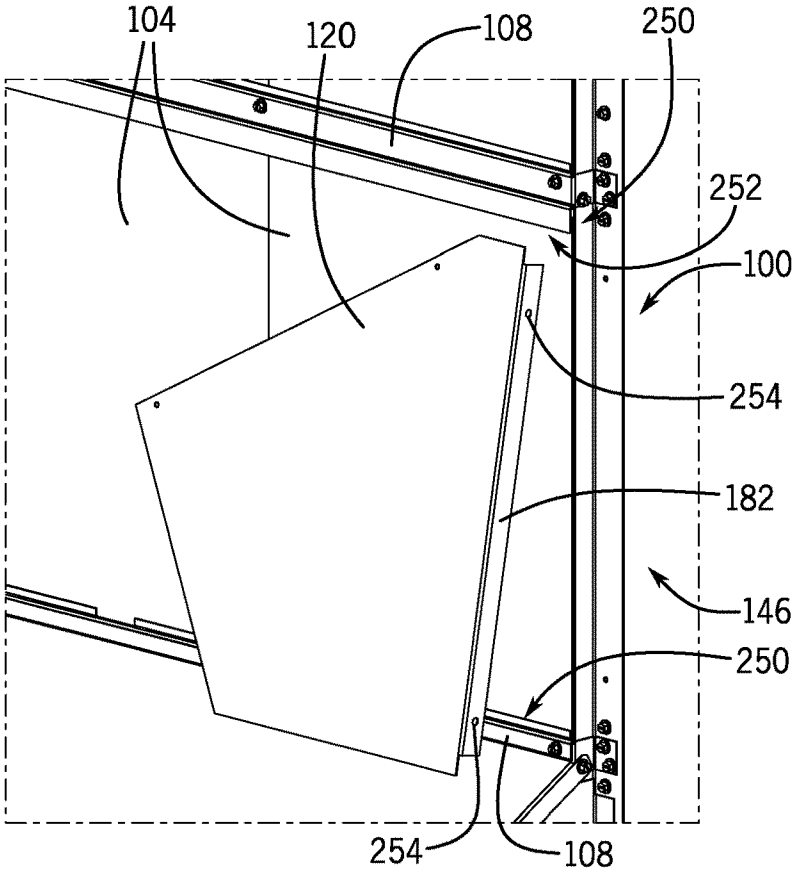
FIG. 17 is a perspective view of an embodiment of slidable side panels of the hood assembly, in accordance with an aspect of the present disclosure.

In still further embodiments, the side panels 120 may be removed and slidably inserted into grooves 250 of the bracket assembly 108. For example, FIGS. 17 and 18 are perspective views illustrating insertion of the side panels 120 into the grooves 250 of the bracket assembly 108. As shown in the illustrated embodiment, the filters 104 may also be disposed within the grooves 250. A gap 252 may be present between the grooves 250 and the filters 104 that may accommodate a thickness of the side panels 120 and enable the side panels 120 to be slidably inserted into the grooves 250 and retained against the filters 104 and bracket assembly 108.

As discussed above, the hood assembly 122 includes a pair of the side panels 120 that couple to opposite ends 146, 148 of the primary panel 132. In some embodiments, the first side panel 120 coupled to the first end 146 of the primary panel 132 when in the operating position 230 may be disposed in the groove 250 proximate to the second end 148 of the primary panel 132. Similarly, the second side panel 120 coupled to the second end 148 of the primary panel 132 when in the operating position 230 may be disposed in the groove 250 proximate to the first end 146 of the primary panel 132. In other words, the positions of the first and second panels 120 may be switched about the primary panel 132 to enable the lip 182 extending from the first edge 128 of the panel 120 to be coupled to the frame portion 214 upon sliding the panel 120 into the groove 250. As such, openings 254 extending through the lip 182 may be aligned with corresponding openings in the frame portion 214, such that fasteners may extend through the openings 254 and into the frame portion 214 to couple the side panel 120 to the frame portion 214. For instance, FIG. 19 is a perspective view of the hood assembly 122, where the side panels 120 are disposed in the groove 250 of the bracket assembly 108 and fasteners 260 are disposed in the openings 254, thereby coupling the side panel 120 to the frame portion 214.

Figure 19:
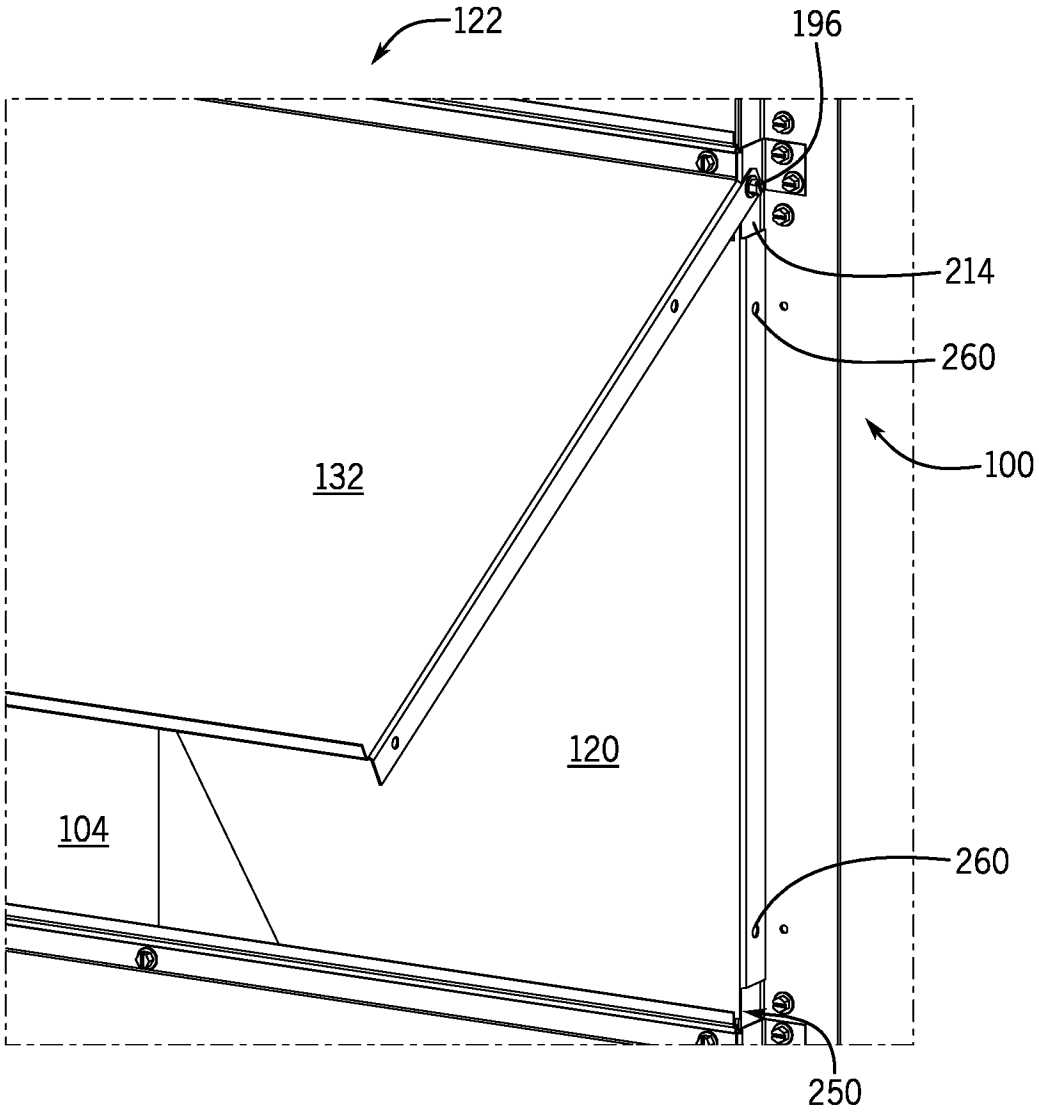
FIG. 19 is a perspective view of an embodiment of the slidable side panels of the hood assembly in a collapsed position, in accordance with an aspect of the present disclosure.
Figure 20:
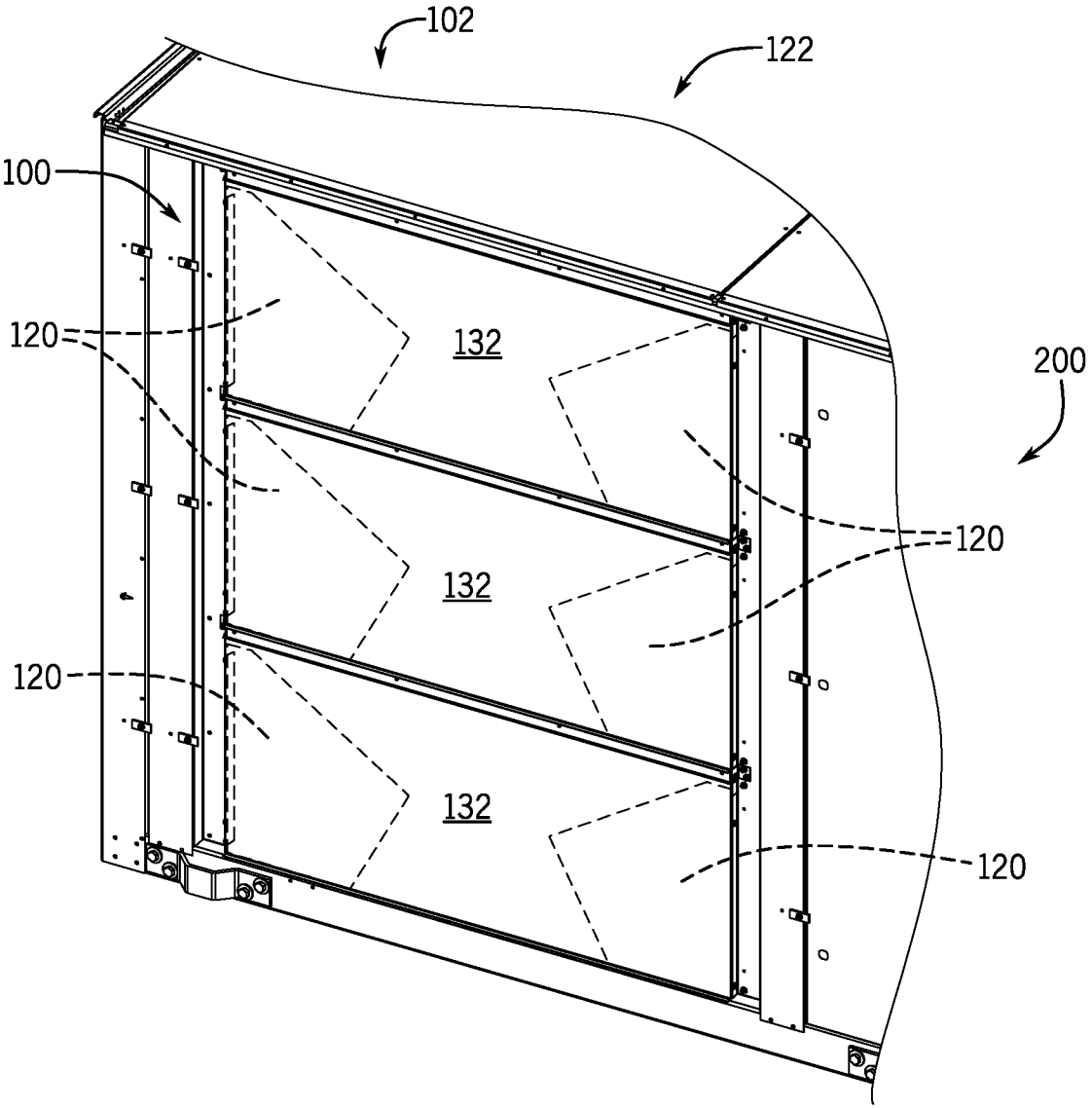
FIG. 20 is a perspective view of an embodiment of the slidable side panels and foldable primary panels of the hood assembly in a collapsed position, in accordance with an aspect of the present disclosure.

As shown in the illustrated embodiment of FIG. 19, the primary panel 132 is in the operating position, as the fastener 196 is tightened against the frame portion 214. Once the side panels 120 are each disposed within the groove 250 and/or fastened to the frame portion 214 via the fasteners 260, the fastener 196 may be loosened to rotate the primary panel 132 toward the side 100 of the HVAC unit 102. For example, FIG. 20 is a perspective view of the hood assembly 122 in the collapsed configuration 200, where the side panels 120 are disposed within the grooves 250 of the bracket assembly 108. As such, the hood assembly 122 is substantially flush with the side 100 of the HVAC unit 102, thereby enabling the hood assembly 122 to remain coupled to the HVAC unit 102 during transportation.

Figure 21:
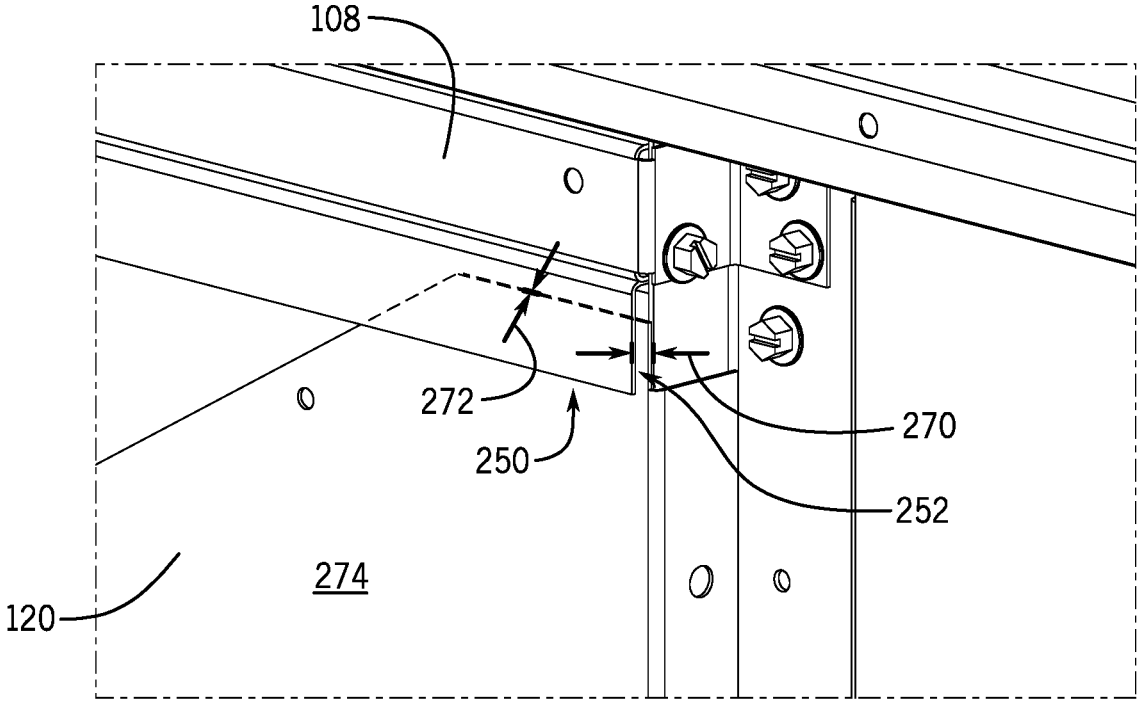
FIG. 21 is an expanded perspective view of an embodiment of the slidable side panels of the hood assembly in the collapsed position, in accordance with an aspect of the present disclosure.
Figure 22:
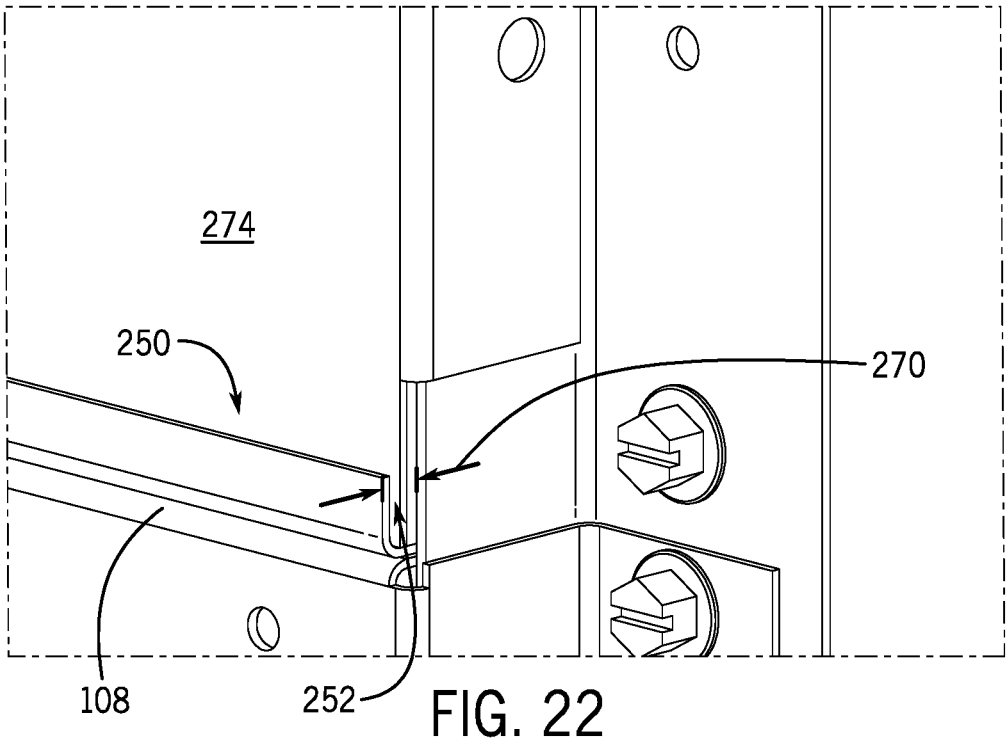
FIG. 22 is an expanded perspective view of an embodiment of the slidable side panels of the hood assembly in the collapsed position, in accordance with an aspect of the present disclosure.

FIGS. 21 and 22 are expanded perspective views of the side panels 120 disposed within the grooves 250 of the bracket assembly 108. As shown in the illustrated embodiments of FIGS. 21 and 22, the gap 252 includes a width 270 that is configured to receive a thickness 272 of a surface 274 of the side panels 120. Accordingly, the side panels 120 may be slidably inserted into the grooves 250 in addition to the filters 104.

Figure 23:
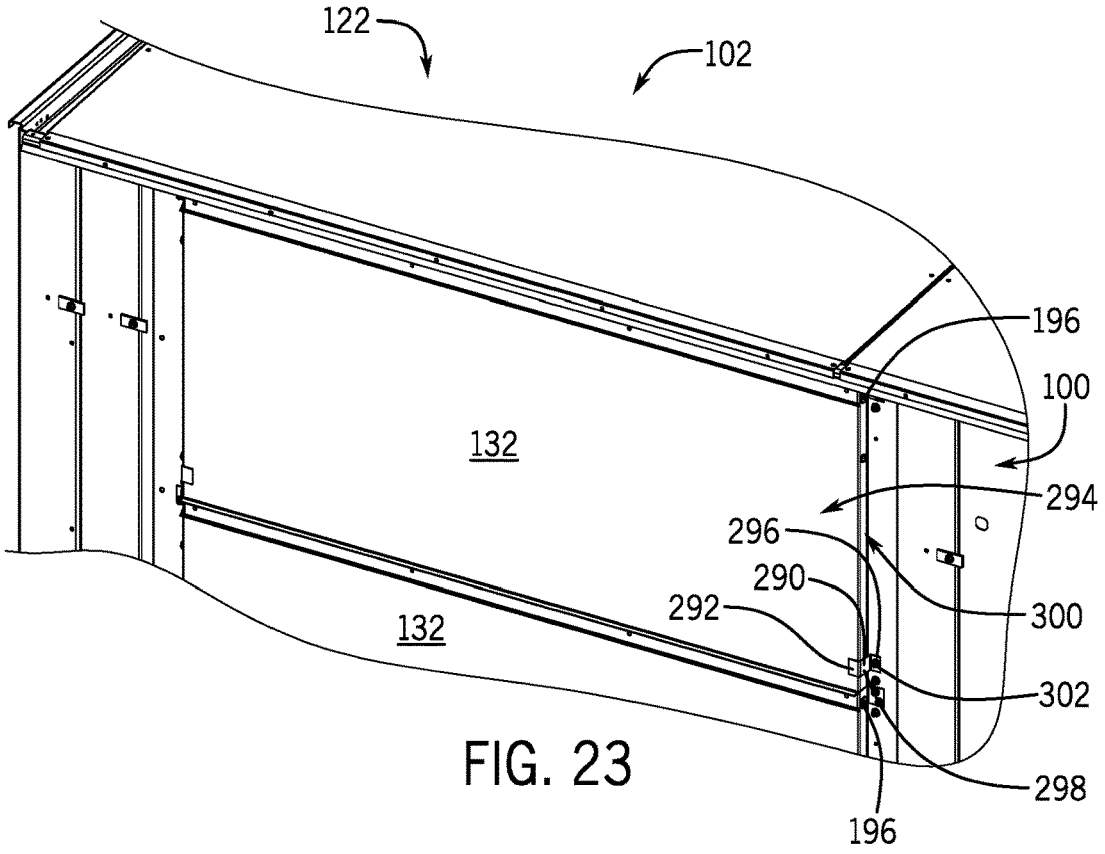
FIG. 23 is a perspective view of an embodiment of the hood assembly secured to the HVAC unit in the collapsed position, in accordance with an aspect of the present disclosure.
Figure 24:
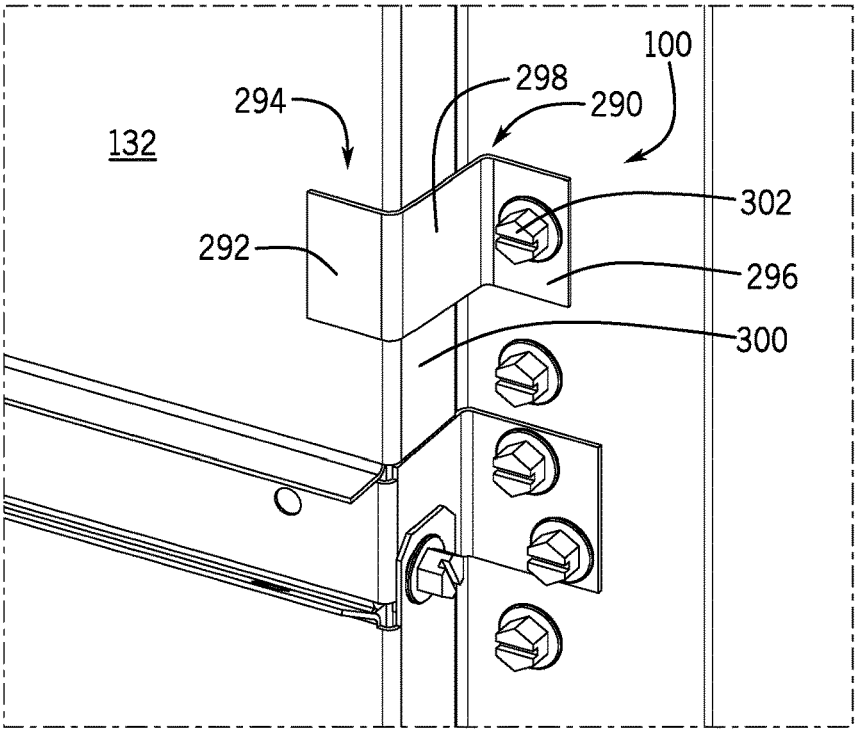
FIG. 24 is an expanded perspective view of an embodiment of a securement element for securing the primary panel to the HVAC unit in the collapsed position, in accordance with an aspect of the present disclosure.

In some embodiments, the primary panel 132 may be secured to the side 100 of the HVAC unit 102 during transportation via the fastener 196. Additionally or alternatively, a securement element or retention feature 290 may be utilized to further secure the primary panel 132 to the side 100 of the HVAC unit 102 and block or restrict movement of the primary panel 132 with respect to the HVAC unit 102. For example, FIGS. 23 and 24 are perspective views of embodiments of the securement element 290 utilized to secure the primary panel 132 to the side 100 of the HVAC unit 102. As shown in the illustrated embodiments of FIGS. 23 and 24, the securement element 290 includes a first arm 292 configured to be positioned over and extend partially along a surface 294 of the primary panel 132, a second arm 296 configured to be positioned adjacent to, and secured to, the side 100 of the HVAC unit 102, and a connection arm 298 configured to be positioned adjacent to and extend along a surface 300 of the primary panel 132. As such, the securement element 290 may form a substantially S-shaped structure, where the first arm 292 and the second arm 296 extend from the connection arm 298 in opposite directions. The second arm 296 is coupled to the side 100 of the HVAC unit 102 via a fastener 302 that extends through the second arm 296 and into the side 100 of the HVAC unit 102. In some cases, the side 100 of the HVAC unit 100 includes a prefabricated opening that may include corresponding threads, thereby enabling the fastener 302 to secure the second arm 296 to the side 100 of the HVAC unit 102. In other embodiments, the opening in the side 100 of the HVAC unit 102 may not include threads and a nut may be configured to be disposed about an end of the fastener in the interior of the HVAC unit 102 to secure the second arm 296 to the side 100 of the HVAC unit 102.

Figure 25:
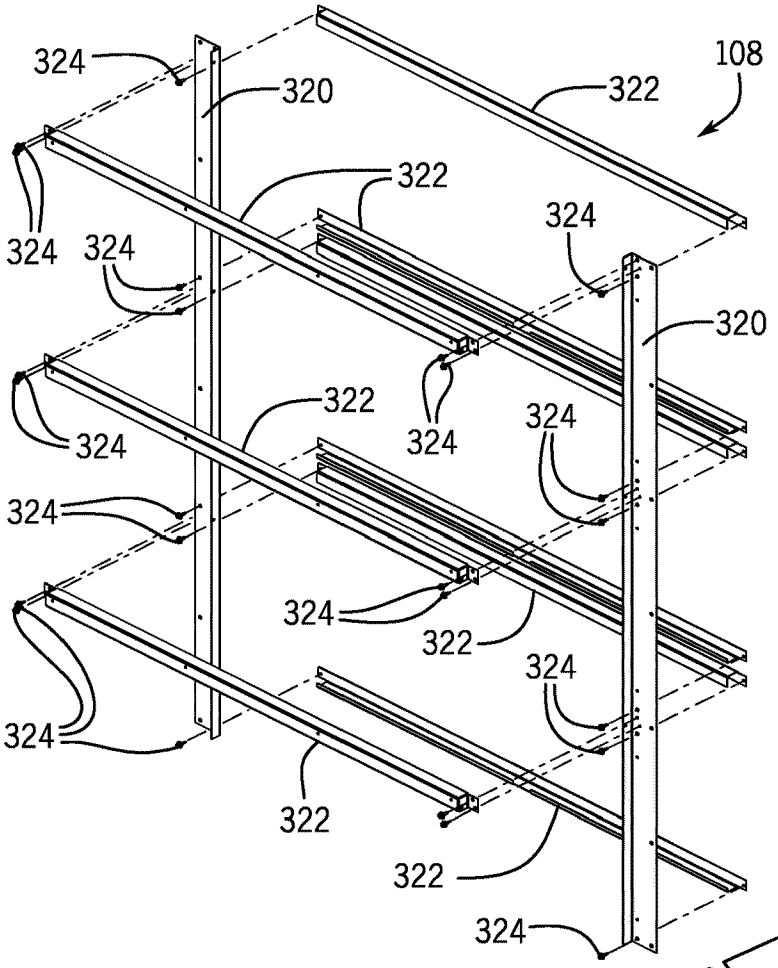
FIG. 25 is an exploded view of an embodiment of a bracket assembly that may be disposed in the HVAC unit and receive the slidable side panels, in accordance with an aspect of the present disclosure.

FIG. 25 is an exploded view of an embodiment of the bracket assembly 108 that may receive the filters 104 and/or the side panels 120. As shown in the illustrated embodiment of FIG. 25, the bracket assembly 108 includes support brackets 320 and a plurality of receptacle brackets 322. The receptacle brackets 322 include the grooves 250 that are configured to receive the filters 104 and/or the side panels 120. In some embodiments, the plurality of receptacle brackets 322 are coupled to a pair of the support brackets 320 to form the bracket assembly 108. For example, receptacle brackets 322 may be coupled to either side of the support brackets 320, such that a pair of receptacle brackets 322 form the groove 250 that receives the filters 104 and/or the side panels 120. Fasteners 324 are disposed through openings in the receptacle brackets 322, through corresponding openings in the support brackets 320, and/or through openings in the side 100 of the HVAC unit 102. The fasteners 324 may secure the receptacle brackets 322 to the support brackets 320 as well as to the side 100 of the HVAC unit 102. Accordingly, the bracket assembly 108 is coupled and/or secured to the side 100 of the HVAC unit 102.

Figure 26:
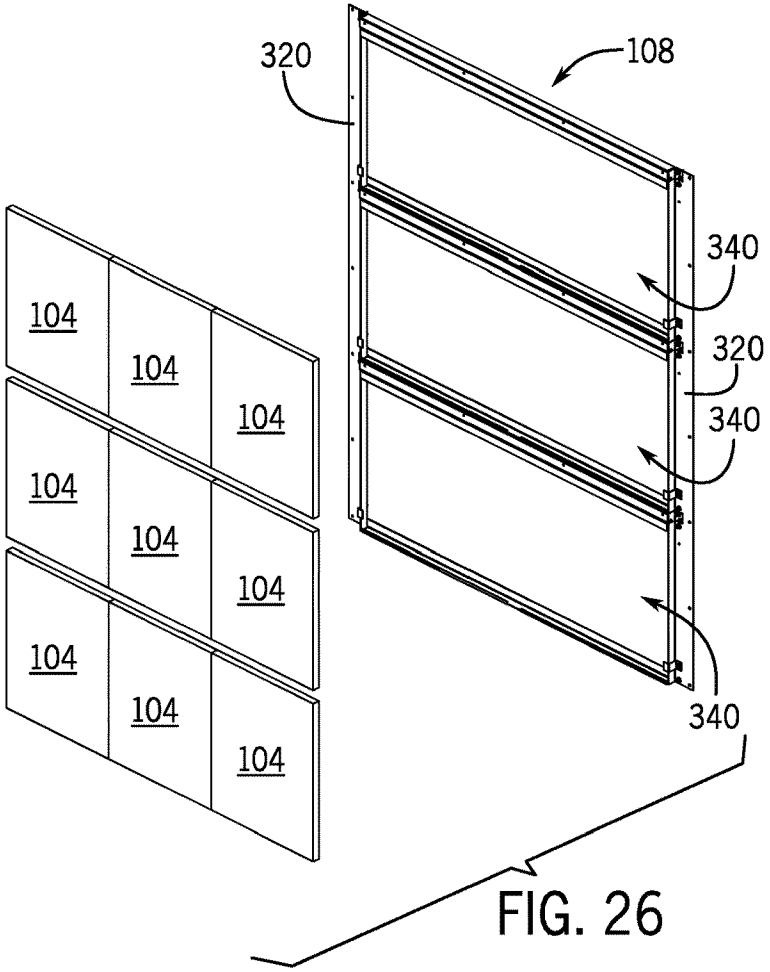
FIG. 26 is a perspective view of an embodiment of filters to be disposed in the bracket assembly of FIG. 25, in accordance with an aspect of the present disclosure.
Figure 27:
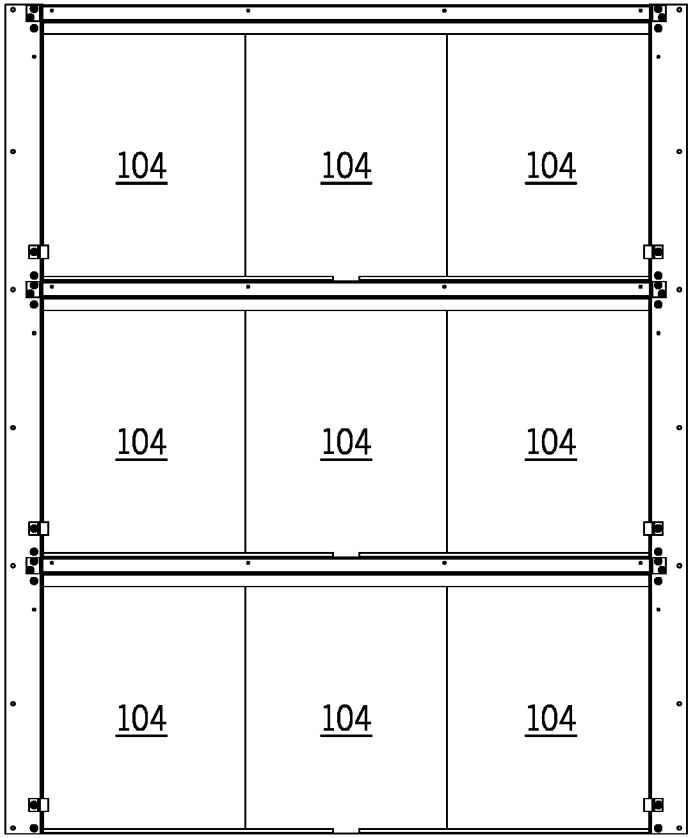
FIG. 27 is an elevation view of an embodiment of the bracket assembly and filters, in accordance with an aspect of the present disclosure.

FIG. 26 is a perspective view of an embodiment of the bracket assembly 108 and the filters 104 to be disposed in the grooves 250 formed by the plurality of receptacle brackets 322. In some embodiments, the filters 104 are substantially square panels, where multiple filters 104 are included in rows 340 formed by the support brackets 320 and the plurality of receptacle brackets 322. In other embodiments, the filters 104 may include other suitable shapes that are configured to be disposed within the grooves 250 of the bracket assembly 108. As such, each of the rows 340 formed by the support brackets 320 and the plurality of receptacle brackets 322 may include one, two, three, four, five, six, seven, eight, nine, ten, or more of the filters 104. In any case, the filters 104 may be configured to block particulates and/or other contaminants from entering the interior of the HVAC unit 102 that may be present in the air flowing through the gaps 156 between the primary panels 132 of the hood assembly 122. FIG. 27 is an elevation view of the bracket assembly 108 with the filters 104 disposed in the grooves 250.

Figure 28:
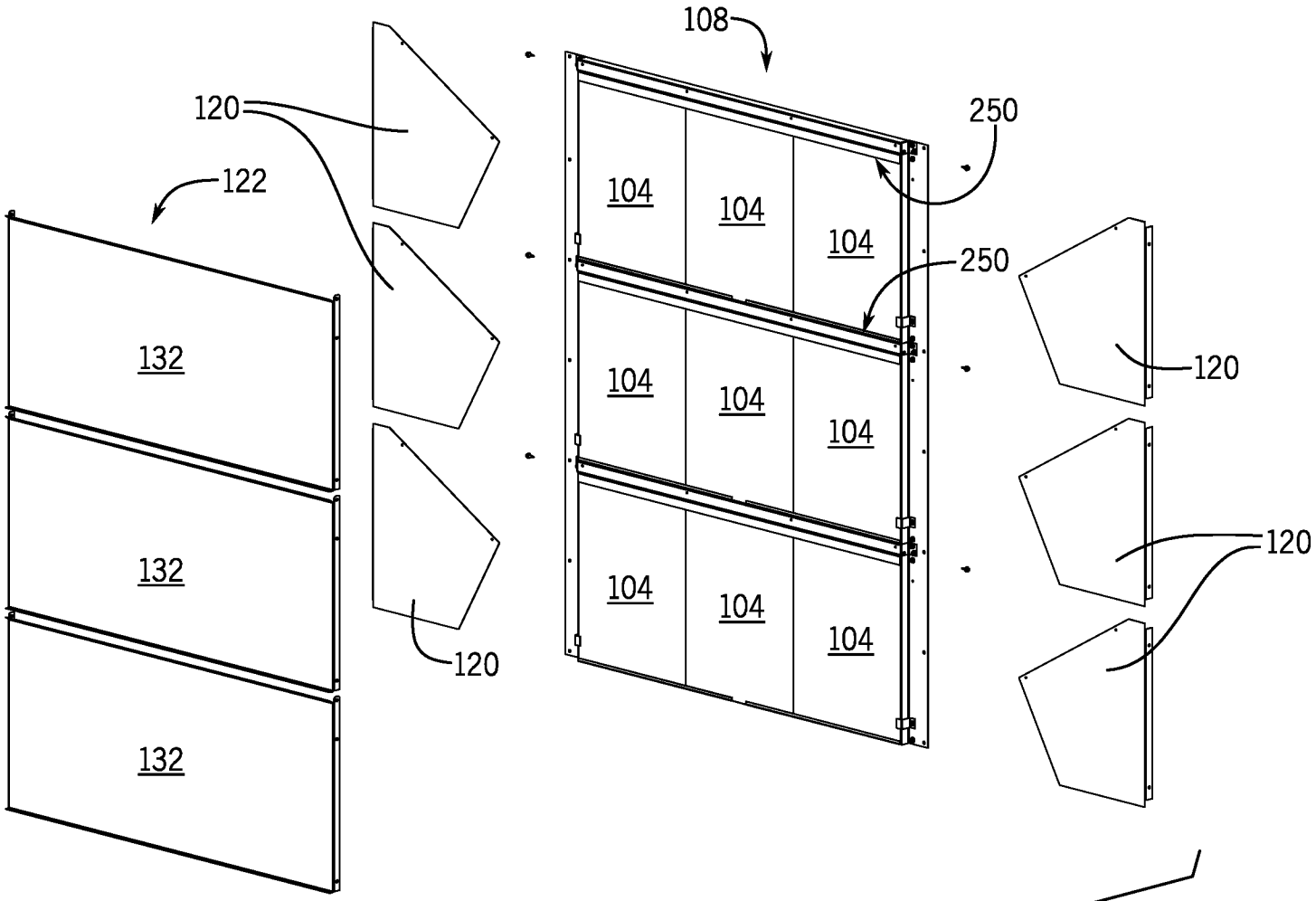
FIG. 28 is an exploded perspective view of an embodiment of the slidable side panels of the hood assembly with respect to the bracket assembly of FIGS. 25-27, in accordance with an aspect of the present disclosure.

FIG. 28 is an exploded perspective view of the assembled bracket assembly 108, illustrating the side panels 102 to be slidably inserted into the grooves 250 with the filters 104, as well as the primary panels 132. As discussed above, the side panels 120 may be inserted into the grooves 250 to position the hood assembly 122 into the collapsed position 200, such that the hood assembly 122 may be transported with the HVAC unit 102 without substantially increasing a footprint of the HVAC unit 102.

As set forth above, embodiments of the present disclosure may provide one or more technical effects useful in assembling and/or transporting HVAC systems. For example, embodiments of the present disclosure are directed to a collapsible hood assembly that reduces transportation costs and/or assembly costs by enabling a hood to remain coupled to an HVAC unit during transportation. In some embodiments, the side panels of the collapsible hood assembly are configured to be disposed in a pocket of primary panels to transition the collapsible hood assembly from an operating position to a collapsed position. In other embodiments, the side panels are configured to fold and/or rotate with respect to a side of the HVAC unit to transition the collapsible hood from the operating position to the collapsed position. In still further embodiments, the side panels may be slidably inserted into grooves of a bracket assembly that receives filters of the HVAC unit. In any case, the primary panel may be rotated with respect to the side of the HVAC unit, such that the hood assembly is substantially flush with the side of the HVAC unit. Accordingly, the hood assembly is coupled to the HVAC unit without significantly increasing a size of the HVAC unit during transportation. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

an HVAC unit comprising a housing;

a heat exchanger disposed within the housing; and a collapsible hood coupled to a side of the housing, comprising:

a plurality of panels coupled to the housing of the HVAC unit wherein the plurality of panels is configured to be translated between a collapsed position and an operating position, wherein the plurality of panels is substantially flush against the housing in the collapsed position to configure the HVAC unit for transportation, wherein the plurality of panels is configured to extend from the housing to form a protected air intake passage of the housing in the operating position, wherein the protected air intake passage comprises an opening disposed at least partially beneath one or more panels of the plurality of panels, and wherein the plurality of panels comprises a first panel and a second panel configured to extend away from the side of the housing in a direction substantially crosswise to the side, and comprises a third panel configured to couple to the first panel and the second panel and extend from the first panel to the second panel to form the protected air intake passage.

2. The HVAC system of claim 1, wherein the first panel of the plurality of panels is configured to be disposed within a pocket of the third panel of the plurality of panels in the collapsed position.

3. The HVAC system of claim 2, wherein the first panel of the plurality of panels is configured to be coupled to the third panel of the plurality of panels via a fastener in the collapsed position.

4. The HVAC system of claim 2, wherein the first panel of the plurality of panels comprises a first edge configured to couple to the housing in the operating position and a second edge configured to couple to the third panel of the plurality of panels in the operating position.

5. The HVAC system of claim 4, wherein the first edge of the first panel of the plurality of panels is configured to couple to the third panel of the plurality of panels in the collapsed position.

6. The HVAC system of claim 1, wherein the third panel of the plurality of panels is coupled to the housing via a hinged connection, and the third panel is configured to rotate toward the housing when transitioning from the operating position to the collapsed position.

7. The HVAC system of claim 6, wherein the hinged connection comprises a bracket fixedly coupled to a frame portion of the housing and rotatably coupled to the third panel of the plurality of panels.

8. The HVAC system of claim 1, wherein the first panel of the plurality of panels is configured to be disposed in a groove of a bracket assembly in the collapsed position, wherein the bracket assembly is coupled to the housing.

9. The HVAC system of claim 8, wherein the first panel of the plurality of panels is disposed adjacent to a filter of the HVAC unit disposed in the groove of the bracket assembly when the plurality of panels is in the collapsed position.

10. The HVAC system of claim 8, wherein the first panel of the plurality of panels is configured to be slidably inserted into the groove of the bracket assembly to transition from the operating position to the collapsed position.

11. The HVAC system of claim 1, wherein the third panel of the plurality of panels is configured to be coupled to the housing in the operating position via a plurality of first fasteners and a plurality of second fasteners.

12. The HVAC system of claim 11, wherein the third panel of the plurality of panels is configured to transition from the operating position to the collapsed position via removal of the plurality of first fasteners and via loosening of the plurality of second fasteners.

13. The HVAC system of claim 12, wherein the third panel of the plurality of panels is configured to rotate about the plurality of second fasteners with respect to the housing to transition from the operating position to the collapsed position.

14. The HVAC system of claim 13, wherein the third panel of the plurality of panels is configured to be secured to the housing in the collapsed position via a securement.

15. The HVAC system of claim 14, wherein the securement comprises a substantially S-shaped structure.

16. The HVAC system of claim 1, wherein the plurality of panels is configured to at least partially cover a filter of the HVAC unit to block contaminants from entering the housing of the HVAC unit when in the operating position.

17. A heating, ventilation, and air conditioning (HVAC) system, comprising:

an HVAC unit comprising a housing;

a heat exchanger disposed within the housing; and a collapsible hood assembly configured to couple to a side of the housing, comprising:

a plurality of side panels configured to couple to the side of the housing in an operating position to extend away from the housing in a direction substantially crosswise to the side; and a plurality of primary panels configured to couple to the side of the housing and to the plurality of side panels in the operating position, wherein the plurality of side panels and the plurality of primary panels cooperatively form a plurality of protected air intake passages of the housing of the HVAC unit in the operating position, wherein each protected air intake passage of the plurality of protected air intake passages comprises an opening configured to receive air directed into the HVAC unit, wherein the opening is disposed at least partially beneath a respective primary panel of the plurality of primary panels corresponding to a respective protected air intake passage of the plurality of protected air intake passages, wherein the plurality of side panels and the plurality of primary panels are configured to be adjusted from the operating position to a collapsed position, and wherein the plurality of side panels and the plurality of primary panels are substantially flush against the side of the housing in the collapsed position, such that the HVAC unit is configured to be transported in the collapsed position.

18. The HVAC system of claim 17, wherein a pair of side panels of the plurality of side panels is configured to couple to a primary panel of the plurality of primary panels to form a protected air intake passage of the plurality of protected air intake passages in the operating position.

19. The HVAC system of claim 17, wherein a side panel of the plurality of side panels is configured to be disposed in a pocket of a primary panel of the plurality of primary panels in the collapsed position.

20. The HVAC system of claim 17, comprising a hinged connection configured to couple a side panel of the plurality of side panels to the side of the housing, wherein the side panel is configured to rotate toward the side of the housing in a transition from the operating position to the collapsed position.

21. The HVAC system of claim 17, wherein a side panel of the plurality of side panels is configured to be disposed in a groove of a bracket assembly in the collapsed position, wherein the bracket assembly is disposed in an air intake opening of the side of the housing.

* * * * *